US008746691B2

(12) United States Patent
Nakamura et al.

(10) Patent No.: US 8,746,691 B2
(45) Date of Patent: Jun. 10, 2014

(54) IMAGE FORMING APPARATUS

(71) Applicant: Konica Minolta, Inc., Tokyo (JP)

(72) Inventors: Hajime Nakamura, Hachioji (JP); Makoto Ui, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/889,495

(22) Filed: May 8, 2013

(65) Prior Publication Data

US 2013/0320615 A1 Dec. 5, 2013

(30) Foreign Application Priority Data

Jun. 4, 2012 (JP) ..... 2012-127165

(51) Int. Cl.
*B65H 5/00* (2006.01)

(52) U.S. Cl.
USPC ..... 271/225; 271/185; 271/186

(58) Field of Classification Search
USPC ..... 271/184–186, 225, 301
See application file for complete search history.

(56) References Cited

U.S. PATENT DOCUMENTS

| | | | | |
|---|---|---|---|---|
| 6,409,008 | B1 * | 6/2002 | Newsome | 198/403 |
| 6,554,276 | B2 * | 4/2003 | Jackson et al. | 271/301 |
| 6,607,320 | B2 * | 8/2003 | Bobrow et al. | 400/188 |
| 7,168,701 | B2 * | 1/2007 | Isaka et al. | 271/273 |
| 7,766,322 | B2 * | 8/2010 | Nakamura et al. | 271/184 |
| 8,437,684 | B2 * | 5/2013 | Mizuno et al. | 399/401 |
| 8,480,079 | B2 * | 7/2013 | Sugano et al. | 271/225 |
| 8,579,283 | B2 * | 11/2013 | Isobe et al. | 271/225 |
| 2006/0071414 | A1 * | 4/2006 | Kawatsu et al. | 271/225 |
| 2007/0235925 | A1 * | 10/2007 | Johnston et al. | 271/301 |
| 2010/0278575 | A1 | 11/2010 | Mizuno et al. | |
| 2011/0049792 | A1 | 3/2011 | Suzuki | |
| 2012/0248680 | A1 * | 10/2012 | Takaishi et al. | 271/109 |

FOREIGN PATENT DOCUMENTS

| | | |
|---|---|---|
| EP | 2 613 201 | 7/2013 |
| JP | 2003-122072 A | 4/2003 |
| JP | 2003-241454 A | 8/2003 |
| JP | 2010-260680 A | 11/2010 |

OTHER PUBLICATIONS

European Search Report 13 16 7161, Dated: Dec. 18, 2013 (5 pages).

* cited by examiner

*Primary Examiner* — Kaitlin Joerger
(74) *Attorney, Agent, or Firm* — Lucas & Mercanti, LLP

(57) ABSTRACT

An image forming apparatus includes an image forming section to form an image on a sheet, a reversing section to reverse the sheet between front and rear surfaces, and an apparatus main body that houses the image forming section and the reversing section. The reversing section includes a lower-side horizontal conveying path arranged horizontally and adapted to convey the sheet, an upper-side horizontal conveying path arranged vertically above the lower-side horizontal conveying path and extending parallel to the lower-side horizontal conveying path, and a connection conveying path which connects the lower-side horizontal conveying path and the upper-side horizontal conveying path and is detachably coupled to the upper-side horizontal conveying path. The reversing section is horizontally supported by the apparatus main body so as to be movable along a direction in which the sheet is sent from the lower-side horizontal conveying path or upper-side horizontal conveying path to the connection conveying path.

8 Claims, 4 Drawing Sheets

FIG. 2
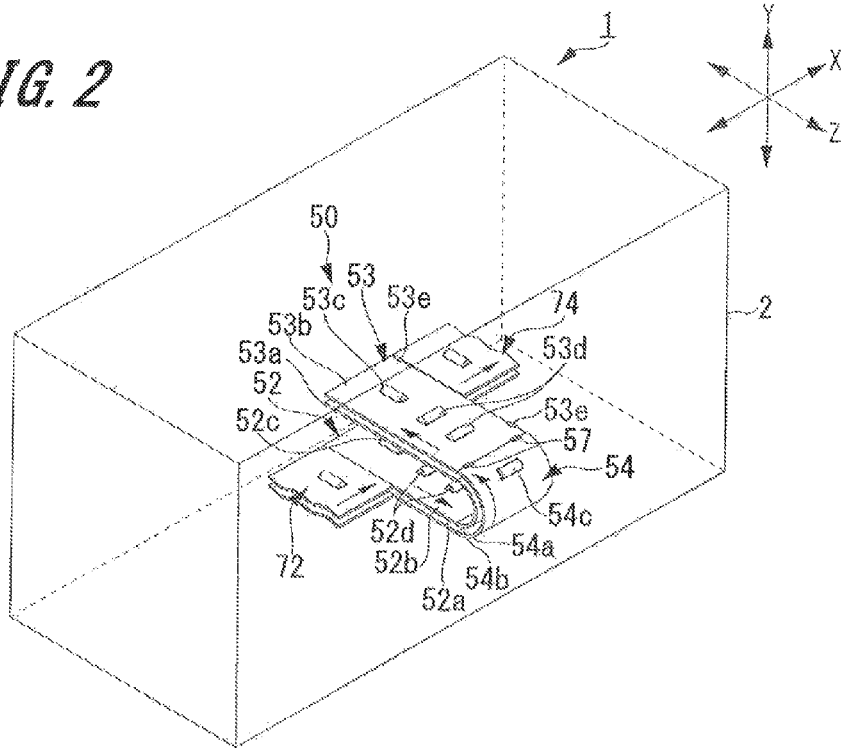
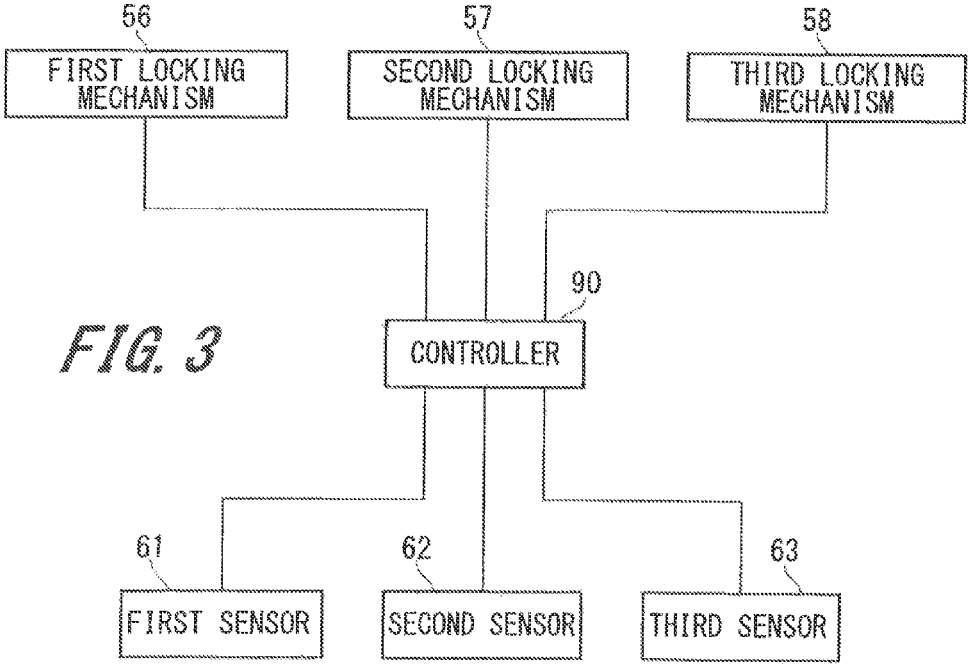
FIG. 3

IMAGE FORMING APPARATUS

CROSS REFERENCES TO RELATED APPLICATIONS

The present invention contains subject matter related to Japanese Patent Application JP 2012-127165 filed in the Japanese Patent Office on Jun. 4, 2012, the entire contents of which being incorporated herein by reference.

BACKGROUND OF THE INVENTION

1. Field of the Invention

The present invention relates to an image forming apparatus having a reversing section for forming image on both the front surface and the rear surface of a sheet, particularly to an image forming apparatus having two horizontal conveying paths superimposed on each other and substantially parallel to each other.

2. Description of the Related Art

In an image forming apparatus, in order to form an image on a sheet, a photoreceptor is electrically-charged and then the electrical charges are erased according to a document image (i.e., the photoreceptor is so-called "exposed"), so that an electrostatic latent image is formed on the photoreceptor. Thereafter, a developing section is used to cause the toner to adhere to the electrostatic latent image of the photoreceptor so as to form a toner image. Further, the toner image formed on the photoreceptor is transferred to the sheet through a transfer material such as an intermediate transfer belt or the like, and the toner image transferred to the sheet is fixed to the sheet by a fixing section, and thereby an image is formed on the sheet. Further, the sheet having the toner image fixed thereto is conveyed through a sheet conveying path.

Further, in the case where it is necessary to form images on both the front and rear surfaces of the sheet, the sheet is conveyed to a reversing section through the sheet conveying path. The reversing section has an upper-side horizontal conveying path, a lower-side horizontal conveying path, and a U-shaped connection conveying path, wherein the upper-side horizontal conveying path and the lower-side horizontal conveying path are superimposed on each other and substantially parallel to each other in the vertical direction of the apparatus main body, and the connection conveying path connects an upper reversing path and a lower reversing path.

When a sheet jam occurs in the reversing section, the reversing section shall be drawn out from the apparatus main body to perform jam handling operation. In an image forming apparatus described in Japanese Unexamined Patent Application Publication No. 2003-241454, a lower conveying section, which constitutes a conveying path unit, is drawn out from the conveying path unit, and a mirror surface is formed in a portion of the lower conveying section. The status of the jammed sheet in the lower conveying section can be confirmed from the mirror surface formed in the lower conveying section.

SUMMARY OF THE INVENTION

However, in the image forming apparatus described in Japanese Unexamined Patent Application Publication No. 2003-241454, since the upper portion of the lower conveying section is covered by an upper conveying section, when performing jam handling operation on the lower conveying section, the operation has to be performed from the lower side of the lower conveying section.

In view of the problems of the aforesaid prior art, one of the objects of the present invention is to provide an image forming apparatus capable of performing jam handling operation from upper side, no matter the jam occurs in the upper-side horizontal conveying path or in the lower-side horizontal conveying path.

To solve the aforesaid problems and achieve the aforesaid object of the present invention, an image forming apparatus reflecting one aspect of the present invention includes an image forming section adapted to form an image on a sheet, a reversing section adapted to reverse the sheet between the front surface and the rear surface, and an apparatus main body that houses the image forming section and the reversing section.

The reversing section includes a lower-side horizontal conveying path, an upper-side horizontal conveying path, and a connection conveying path.

The lower-side horizontal conveying path is arranged horizontally and adapted to convey the sheet. The upper-side horizontal conveying path is arranged vertically above the lower-side horizontal conveying path and extends in parallel with the lower-side horizontal conveying path. The connection conveying path connects the lower-side horizontal conveying path and the upper-side horizontal conveying path to each other, and is detachably coupled to the upper-side horizontal conveying path. Further, the reversing section is horizontally supported by the apparatus main body so as to be movable along a direction in which the sheet is sent from the lower-side horizontal conveying path or the upper-side horizontal conveying path to the connection conveying path.

BRIEF DESCRIPTION OF THE DRAWINGS

FIG. 2 is a view showing a schematic configuration of a reversing section of the image forming apparatus according to the aforesaid embodiment;

FIG. 3 is a block diagram showing a control system of the reversing section of the image forming apparatus according to the aforesaid embodiment;

DETAILED DESCRIPTION OF THE PREFERRED EMBODIMENT

Figure 1:
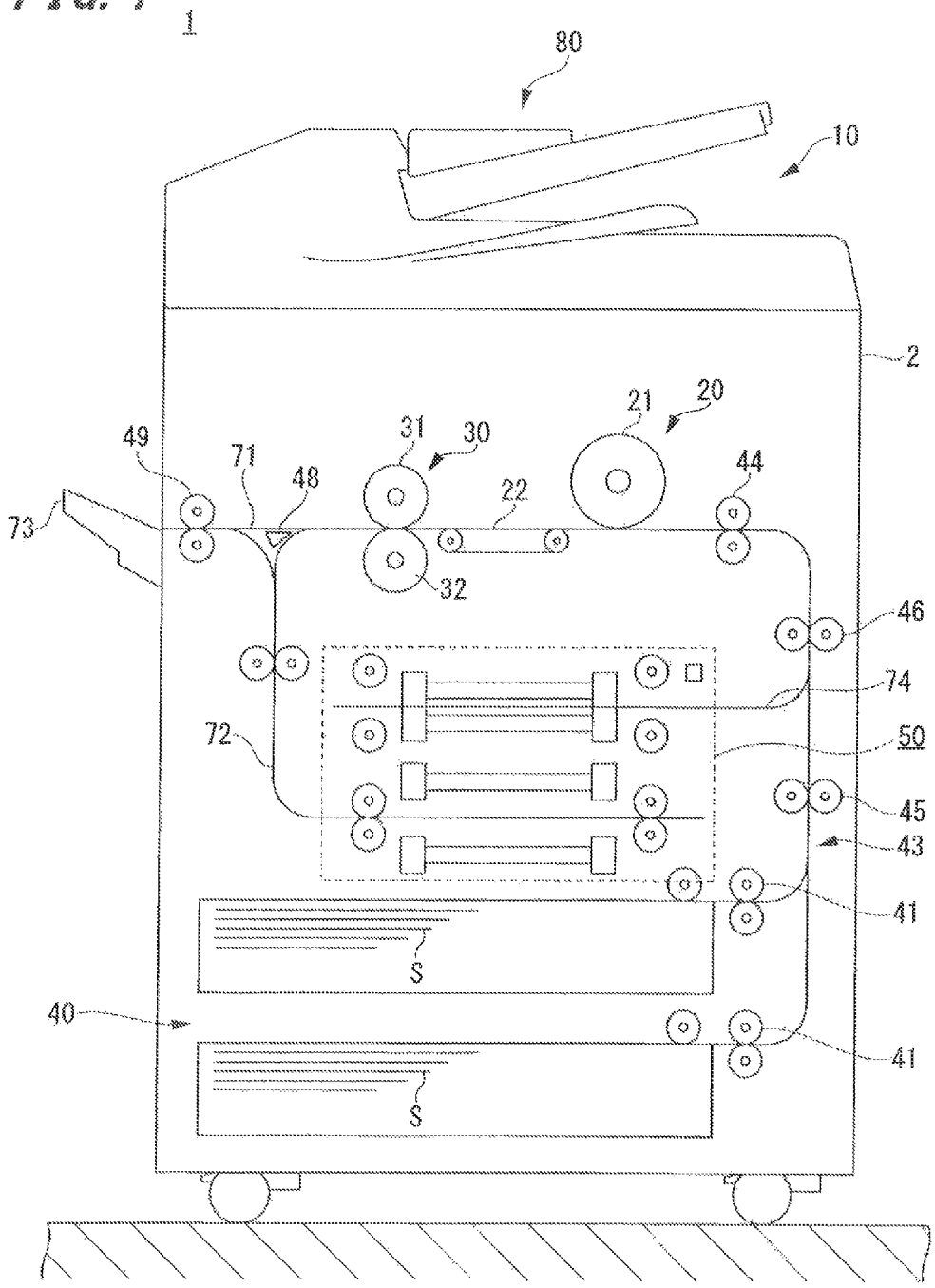
FIG. 1 is a view showing overall configuration of an image forming apparatus according to an embodiment of the present invention.

An image forming apparatus according to an embodiment of the present invention will be described below with reference to FIGS. 1 to 7. In FIGS. 1 to 7, like components are denoted by like reference numerals. Note that the description given in this column is not intended to limit the technical scope and meaning of the technical terms described in the claims of the present invention.

1. Configuration Example of Image Forming Apparatus

First, a configuration example of an image forming apparatus 1 according to an embodiment (referred to as "present embodiment" hereinafter) of the present invention will be described below with reference to FIG. 1.

FIG. 1 is a view showing overall configuration of the image forming apparatus 1.

The image forming apparatus 1 is adapted to form an image on a sheet based on electrophotographic technology. The image forming apparatus 1 includes an image reading section 10, an image forming section 20, a fixing section 30, a plurality of sheet accommodating sections 40, a reversing section 50 adapted to switch the sheet, and a controller 90, wherein the image forming section 20, the fixing section 30, the sheet accommodating sections 40, the reversing section 50 and the controller 90 are arranged inside an apparatus main body 2. The image forming apparatus 1 further includes a document conveying section 80 adapted to convey a document page by page to a reading position of the image reading section 10.

Note that, although the image forming apparatus 1 described in the present embodiment is a device that forms the image based on electrophotographic technology, the image forming apparatus is not limited thereto, but may also be a device that forms the image based on other technologies such as ink-jet technology, thermal transfer technology, silver halide photography technology and the like.

The document conveying section 80 is arranged in the upper portion of the apparatus main body 2. The document conveying section 80 conveys the document page by page to the reading position of the image reading section 10. The image reading section 10 reads the image of the document conveyed by the document conveying section 80 or the image of a document placed on a platen, and generates image data.

Further, the image reading section 10 has an image reading control section (not shown). The image reading control section performs various processing, such as shading correction, dither processing, compression and/or the like, on the image data created by A/D conversion, and stores the resultant data in the controller 90, which is to be described later. Incidentally, the image data is not limited to the data outputted from the image reading section 10, but may also be data received from an external device (such as a personal computer, another image forming apparatus or the like) connected to the image forming apparatus 1.

The plurality of sheet accommodating sections 40 are arranged in the lower portion of the apparatus main body 2, and the number of the sheet accommodating sections 40 is determined according to the sizes and/or kinds of the sheet S. The sheet S is fed by a sheet feeding section 41 arranged in the sheet accommodating section 40, and is then conveyed to a conveying section 43. Further, the sheet S is conveyed to the transfer position through a pair of resist rollers 44. Further, a plurality of pairs of conveying rollers 45, 46 are provided in the conveying section 43.

The image forming section 20 is arranged between the image reading section 10 and the sheet accommodating section 40. The image forming section 20 has a drum-like photoreceptor 21, a charging section (not shown), an exposure section (not shown), a developing section (not shown), a transfer section (not shown), a separating section (not shown) and a cleaning section (not shown). The charging section, the exposure section, the developing section, the transfer section, the separating section and the cleaning section are arranged around the photoreceptor 21.

The charging section evenly charges the surface of the photoreceptor 21. The exposure section performs exposure scanning on the photoreceptor 21 to form a latent image based on the image data read from the document. The developing section causes the toner to adhere to the electrostatic latent image formed on the photoreceptor 21, so that a toner image is formed on the surface of the photoreceptor 21. The cleaning section removes the toner remaining on the surface of the photoreceptor 21.

The transfer section transfers the toner image adhering on the surface of the photoreceptor 21 to the sheet S sent to the transfer position. The separating section eliminates the charges on the rear surface of the sheet S1, to which the toner image has been transferred, so as to separate the sheet S1 from the photoreceptor 21. The sheet S1 separated from the photoreceptor 21 is conveyed to the fixing section 30 by an intermediate conveying section 22.

The fixing section 30 has a rotatable fixing roller 31 and a rotatable pressing roller 32, wherein the pressing roller 32 and the fixing roller 31 are brought into pressure contact with each other so as to form a fixing nip. The fixing section 30 heats and presses the sheet S by the fixing roller 31 and the pressing roller 32, so that the transferred toner image is heat-fixed to the sheet S.

A switching gate 48 is arranged on the downstream of the conveyance direction of the sheet S1 of the fixing section 30. The switching gate 48 switches the conveying path of the sheet S1 passed through the fixing section 30 between a first sheet-ejecting conveying path 71 and a second sheet-ejecting conveying path 72. To be specific, when ejecting the sheet S with the image side facing up in the case of forming image on one side of the sheet S, the switching gate 48 will cause the sheet S1 to go straight ahead, so that the sheet S is conveyed to the first sheet-ejecting conveying path 71. Therefore, the sheet S is ejected to a sheet receiving tray 73 by a pair of sheet ejecting rollers 49.

Further, when ejecting the sheet S with the image side facing down in the case of forming image on one side of the sheet S, or when forming images on both sides of the sheet S, the switching gate 48 will guide the sheet S downward, so that the sheet S is conveyed to the second sheet-ejecting conveying path 72. When ejecting the sheet S with the image side facing down, after the sheet S has been guided downward by the switching gate 48, the sheet S is reversed by the reversing section 50, and then returned to the side of the switching gate 48. Therefore, the reversed sheet S is ejected to the sheet receiving tray 73.

Further, when forming images on both sides of the sheet S, the sheet S is guided to the second sheet-ejecting conveying path 72 by the switching gate 48, so as to be sent to the reversing section 50. The reversed sheet S is sent to the transfer position again through a sheet re-feeding path 74. Incidentally, the detailed configuration of the reversing section 50 will be described later.

Note that, instead of the sheet receiving tray 73, a post-processing device may alternatively be arranged on the downstream side of the pair of the sheet ejecting rollers 49, wherein the post-processing device is adapted to perform folding processing, stapling processing and/or the like on the sheet S.

2. Configuration Example of Reversing Section

A configuration example of the reversing section will be described below with reference to FIG. 2.

FIG. 2 is a view showing overall configuration of the reversing section.

In FIG. 2, the direction parallel to the horizontal direction of the apparatus main body 2 of the image forming apparatus 1 and in which sheet is conveyed from the second sheet-ejecting conveying path 72 to the reversing section 50 is defined as a "first direction X"; the direction perpendicular to the first direction X and parallel to the vertical direction is defined as a "second direction Y"; and the direction perpendicular to both the first direction X and the second direction Y, and parallel to the horizontal direction of the apparatus main body 2 is defined as a "third direction Z".

As shown in FIG. 2, the reversing section 50 has a lower-side horizontal conveying path 52, an upper-side horizontal conveying path 53, and a connection conveying path 54 that connects the two horizontal conveying paths 52, 53. Further, the reversing section 50 is movably supported by the apparatus main body 2 so that the reversing section 50 can be moved in the third direction Z (see FIG. 4). The lower-side horizontal conveying path 52 and the upper-side horizontal conveying path 53 are arranged horizontally, and are substantially parallel to each other with a predetermined distance therebetween in the second direction Y. The lower-side horizontal conveying path 52 is arranged on the lower side in the second direction Y.

The lower-side horizontal conveying path 52 has a pair of flat plate-like guide plates 52*a*, 52*b*, a conveying roller 52*c*, and two reversing rollers 52*d*. The pair of guide plates 52*a*, 52*b* face each other with a predetermined distance therebetween in the second direction Y. Of the pair of the guide plates 52*a*, 52*b*, the guide plate 52*b* arranged on the upper side in the second direction Y is provided with two hinges 52*e* (see FIG. 6). The guide plate 52*b* is supported by the image 52*e* so that the guide plate 52*b* can be opened and closed with respect to the guide plate 52*a* (see FIG. 7).

The connection conveying path 54 is connected to one end of the lower-side horizontal conveying path 52 in the third direction Z; and on the other end of the lower-side horizontal conveying path 52 in the third direction Z, the second sheet-ejecting conveying path 72 is connected to one side of the lower-side horizontal conveying path 52 in the first direction X. The lower-side horizontal conveying path 52 changes the conveyance direction of the sheet conveyed from the second sheet-ejecting conveying path 72 from the first direction X to the third direction Z. Further, the lower-side horizontal conveying path 52 conveys the sheet to the connection conveying path 54 by using the reversing roller 52*d*. In other words, the lower-side horizontal conveying path 52 changes the conveyance direction of the sheet by approximately 90 degrees substantially horizontally.

Further, the lower-side horizontal conveying path 52 is detachably coupled to the apparatus main body 2 by a first locking mechanism 56 (see FIG. 3). The upper-side horizontal conveying path 53 is arranged above the lower-side horizontal conveying path 52 in the second direction Y.

Similar to the lower-side horizontal conveying path 52, the upper-side horizontal conveying path 53 has a pair of flat plate-like guide plates 53*a*, 53*b*, a conveying roller 53*c*, and two reversing rollers 53*d*. The pair of guide plates 53*a*, 53*b* face each other with a predetermined distance therebetween in the second direction Y. Of the pair of the guide plates 53*a*, 53*b*, the guide plate 53*b* arranged on the upper side in the second direction Y is provided with two hinges 53*e*. The guide plate 53*b* is supported by the hinges 53*e* so that the guide plate 53*b* can be opened and closed with respect to the guide plate 53*a* (see FIG. 5).

The connection conveying path 54 is connected to one end of the upper-side horizontal conveying path 53 in the third direction Z. Further, the upper-side horizontal conveying path 53 and the connection conveying path 54 are detachably coupled to each other by a second locking mechanism 57 (see FIG. 3). Thus, by releasing the second locking mechanism 57, the lower-side horizontal conveying path 52 and the connection conveying path 54 can be separated from the upper-side horizontal conveying path 53 so as to be able to be drawn out in the third direction Z in a state where the lower-side horizontal conveying path 52 and the connection conveying path 54 are connected to each other.

On the other end of the upper-side horizontal conveying path 53 in the third direction Z, the sheet re-feeding path 74 is connected to the other side of the upper-side horizontal conveying path 53 in the first direction X. The upper-side horizontal conveying path 53 changes the conveyance direction of the sheet conveyed from the connection conveying path 54 from the third direction Z to the first direction X, so that the sheet is conveyed to the sheet re-feeding path 74 through the conveying roller 53*c*. In other words, the upper-side horizontal conveying path 53 changes the conveyance direction of the sheet by approximately 90 degrees in a horizontal plane.

Further, the upper-side horizontal conveying path 53 is detachably coupled to the apparatus main body 2 by a third locking mechanism 58 (see FIG. 3).

The connection conveying path 54 has a pair of guide plates 54*a*, 54*b*, and a reversing roller 54*c*. The pair of guide plates 54*a*, 54*b* each curve substantially in U-shape. The pair of guide plates 54*a*, 54*b* face each other with a predetermined distance therebetween in the curvature radius direction. The lower-side horizontal conveying path 52 is arranged on one end of the connection conveying path 54 in the conveyance direction, and the upper-side horizontal conveying path 53 is arranged on the other end of the connection conveying path 54 in the conveyance direction. Thus, the reversing section 50 substantially has a U-shape when viewed from the first direction X. Further, the connection conveying path 54 is arranged on the side of the front surface of the apparatus main body 2. The connection conveying path 54 conveys the sheet conveyed from the lower-side horizontal conveying path 52 to the upper-side horizontal conveying path 53.

Similar to the lower-side horizontal conveying path 52 and the upper-side horizontal conveying path 53, the guide plate 54*b* may also be provided with a hinge, by which the guide plate 54*b* is supported so that the guide plate 54*b* can be opened and closed with respect to the guide plate 54*a*.

The first locking mechanism 56, the second locking mechanism 57 and the third locking mechanism 58 are each configured by, for example, a solenoid, a cam, or the like. Alternatively, the first locking mechanism 56 and the third locking mechanism 58 may each have a configuration in which a projection is provided on the side of the apparatus main body 2, so that the locking mechanism is locked when the lower-side horizontal conveying path 52 and the upper-side horizontal conveying path 53 are pushed into the apparatus main body 2.

Next, a control system of the reversing section 50 will be described below with reference to FIG. 3.

FIG. 3 is a block diagram showing the control system of the reversing section 50.

As shown in FIG. 3, the reversing section 50 has a first sensor 61, a second sensor 62 and a third sensor 63. The first sensor 61 is arranged in the lower-side horizontal conveying path 52, the second sensor 62 is arranged in the upper-side horizontal conveying path 53, and the third sensor 63 is arranged in the connection conveying path 54.

The first sensor 61 is adapted to detect whether or not the sheet has been carried out from the lower-side horizontal conveying path 52, the second sensor 62 is adapted to detect whether or not the sheet has been carried out from the upper-side horizontal conveying path 53, and the third sensor 63 is adapted to detect whether or not the sheet has been carried out from the connection conveying path 54. With the first sensor 61, the second sensor 62 and the third sensor 63, it is possible to defect which is the conveying path where the sheet is located when a sheet jam occurs.

The first sensor 61, the second sensor 62 and the third sensor 63 are connected to the controller 90. The first sensor 61, the second sensor 62 and the third sensor 63 output the detected information to the controller 90.

The controller 90 is connected to the first locking mechanism 56, the second locking mechanism 57 and the third locking mechanism 58. The controller 90 performs sheet jam judgment based on the information obtained from the first sensor 61, the second sensor 62 and the third sensor 63. Further, the controller 90 controls the first locking mechanism 56, the second locking mechanism 57 and the third locking mechanism 58 based on the street jam judgment. Further, based on the command from the controller 90, the first locking mechanism 56, the second locking mechanism 57 and the third locking mechanism 58 perform coupling operation or releasing operation.

3. Jam Handling Method of Reversing Section

Next, the jam handling method of the reversing section 50 having the aforesaid configuration will be described below with reference to FIGS. 4 to 7.

Figure 4:
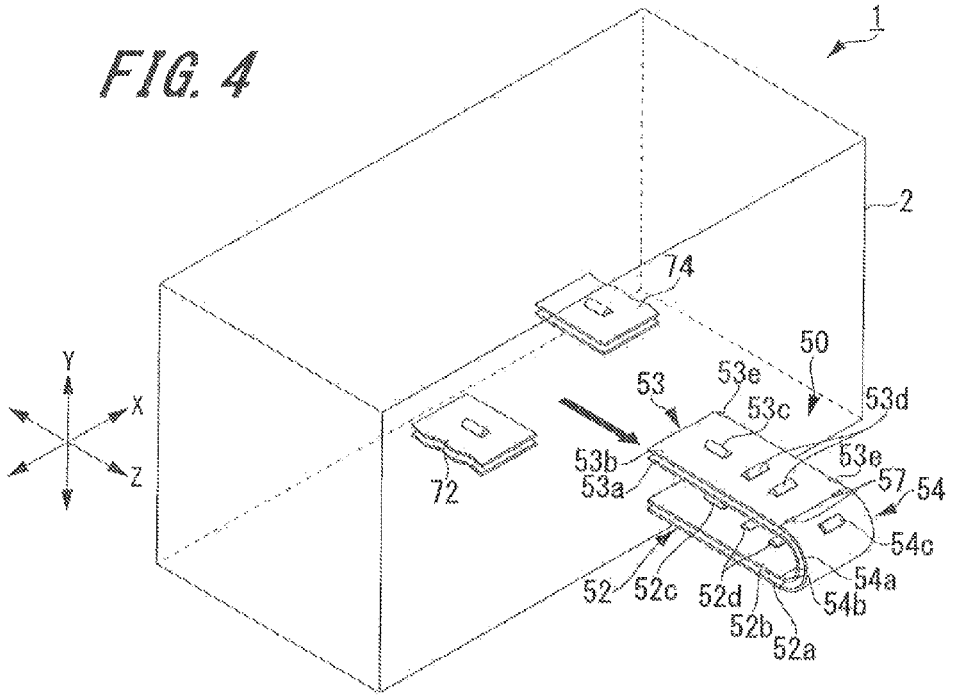
FIG. 4 is a view showing a schematic configuration in a state where the reversing section of the image forming apparatus according to the aforesaid embodiment has been drawn out.
Figure 5:
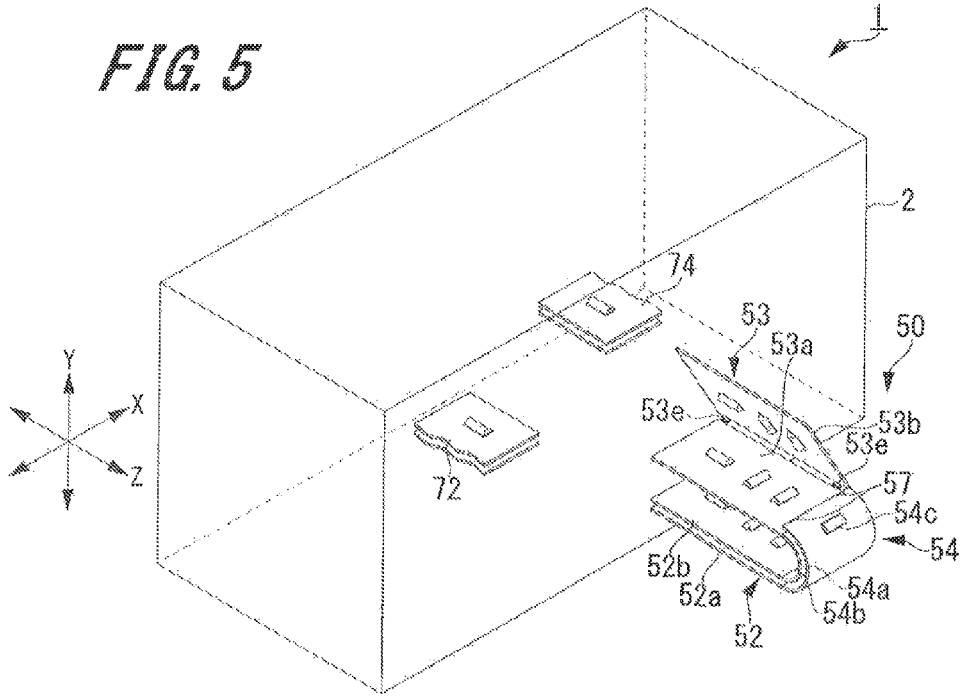
FIG. 5 is a view showing a schematic configuration when performing jam handling operation of an upper-side horizontal conveying path of the reversing section of the image forming apparatus according to the aforesaid embodiment.
Figure 6:
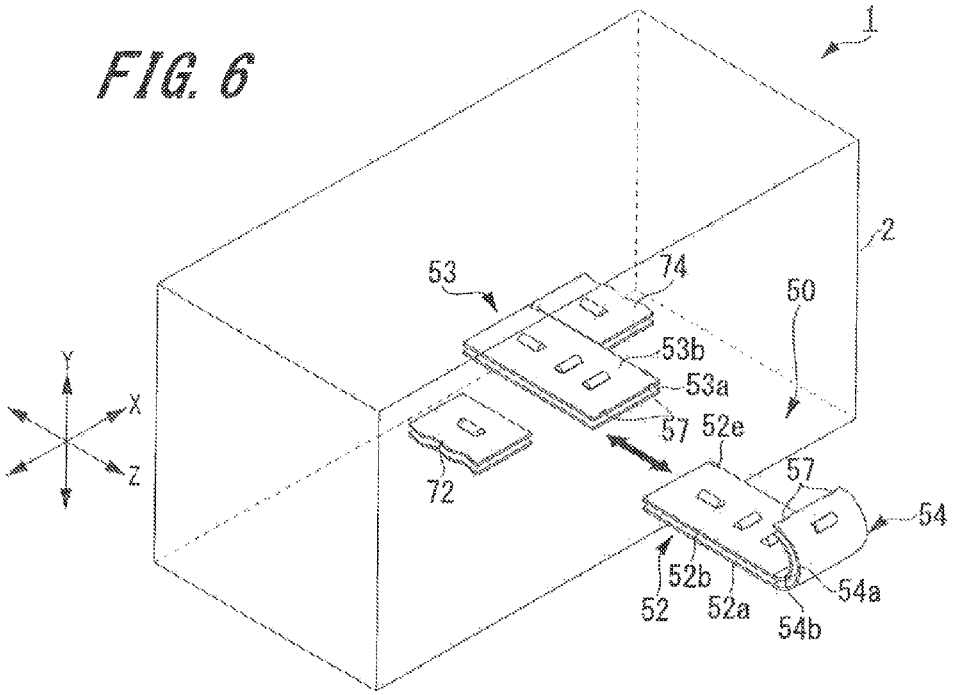
FIG. 6 is a view showing a schematic configuration in a state where a lower-side horizontal conveying path and a connection conveying path of the reversing section of the image forming apparatus according to the aforesaid embodiment have been drawn out.
Figure 7:
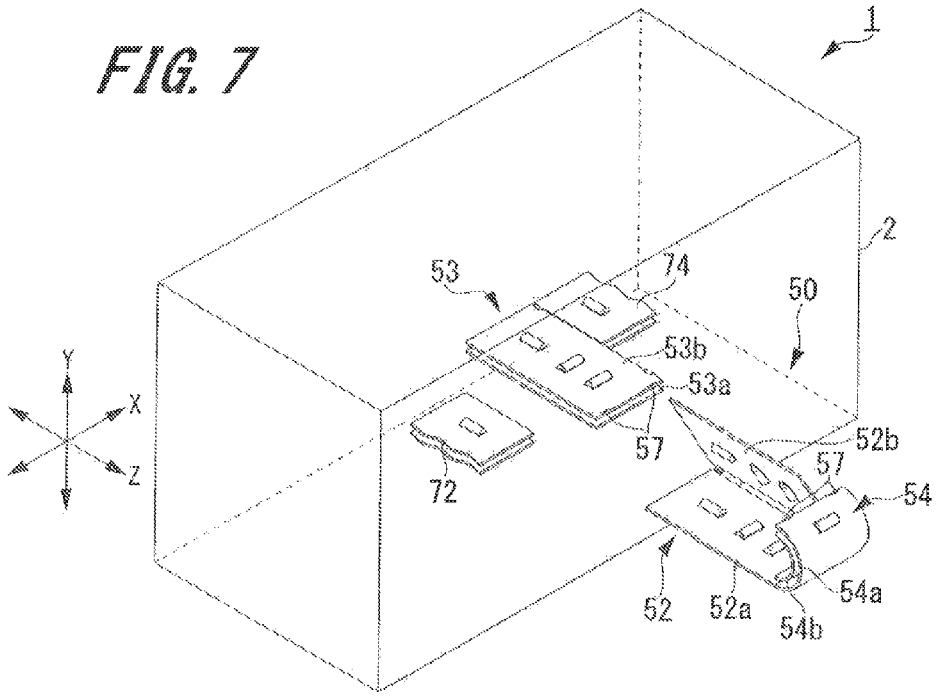
FIG. 7 is a view showing a schematic configuration when performing jam handling operation of the lower-side horizontal conveying path of the reversing section of the image forming apparatus according to the aforesaid embodiment.

FIG. 4 is a view showing a schematic configuration in a state where the reversing section 50 has been drawn out from the apparatus main body 2, FIG. 5 is a view schematically showing a schematic configuration when performing the jam handling operation of the upper-side horizontal conveying path 53, FIG. 6 is a view showing a schematic configuration in a state where the lower-side horizontal conveying path 52 and the connection conveying path 54 have been drawn out from the apparatus main body 2, and FIG. 7 is a view schematically showing a schematic configuration when performing the jam handling operation of the lower-side horizontal conveying path 52.

First, the description will focus on a case where sheet jam occurs only in the upper-side horizontal conveying path 53 (i.e., a case where the sheet is jammed inside the upper-side horizontal conveying path 53). Hereinafter, the sheet in jam state will be referred to as a "jammed sheet".

The controller 90 controls the first locking mechanism 56 and the third locking mechanism 58 to release the coupling between the lower-side horizontal conveying path 52 and the apparatus main body 2 and the coupling between the upper-side horizontal conveying path 53 and the apparatus main body 2. Further, as shown in FIG. 4, the lower-side horizontal conveying path 52, the upper-side horizontal conveying path 53 and the connection conveying path 54 are integrally drawn out from the side of the connection conveying path 54 (i.e., from the front side of the apparatus main body 2) along the third direction Z.

Next, as shown in FIG. 5, the guide plate 53*b* of the upper-side horizontal conveying path 53 is opened, and thereby the upper side of the guide plate 53*a* of the upper-side horizontal conveying path 53 is opened. As a result, jam handling can be performed on the jammed sheet in the upper-side horizontal conveying path 53 from above in the second direction Y.

Next, the description will focus on a case where sheet jam occurs only in the lower-side horizontal conveying path 52.

The controller 90 controls the first locking mechanism 56 and the second locking mechanism 57 to release the coupling between the lower-side horizontal conveying path 52 and the apparatus main body 2 and the coupling between the upper-side horizontal conveying path 53 and the connection conveying path 54, and thereby the connection conveying path 54 is separated from the upper-side horizontal conveying path 53 in a state where the connection conveying path 54 is coupled with the lower-side horizontal conveying path 52.

Next, as shown in FIG. 6, in a state where the upper-side horizontal conveying path 53 remains in coupling with the apparatus main body 2, only the lower-side horizontal conveying path 52 and the connection conveying path 54 are drawn out from the side of the connection conveying path 54 along the third direction Z. Thus, the upper side of the lower-side horizontal conveying path 52 in the second direction Y is opened without being obstructed by the upper-side horizontal conveying path 53.

Next, as shown in FIG. 7, the guide plate 52*b* of the lower-side horizontal conveying path 52 is opened. As a result, jam handling can be performed on the lower-side horizontal conveying path 52 from above in the second direction Y, so that jam handling operation can be facilitated Next, the description will focus on a case where sheet jam occurs in both the lower-side horizontal conveying path 52 and the upper-side horizontal conveying path 53.

First, the controller 90 controls the first locking mechanism 56 and the second locking mechanism 57 to release the coupling between the lower-side horizontal conveying path 52 and the apparatus main body 2 and the coupling between the upper-side horizontal conveying path 53 and the connection conveying path 54. Then, as shown in FIG. 6, only the lower-side horizontal conveying path 52 and the connection conveying path 54 are drawn out from the front side of the apparatus main body 2 along the third direction Z.

Here, in the image forming apparatus described in Japanese Unexamined Patent Application Publication No. 2003-241454, the reversing section is drawn out along a direction perpendicular to the conveyance direction of the sheet of the horizontal conveying path. Thus, in the case where there is a jammed sheet over the course between the horizontal conveying path and the connection conveying path, if the horizontal conveying path and the connection conveying path are drawn out separately, the jammed sheet will be caught on the connection conveying path or the horizontal conveying path, so that it will be difficult to draw out the connection conveying path and the horizontal conveying path. Further, there is a concern that the jammed sheet might be broken by the connection conveying path and the horizontal conveying path, so as to be difficult to take out.

In contrast, in the present embodiment, the upper-side horizontal conveying path 53 and the connection conveying path 54 are separated from each other in a substantially horizontal portion of the reversing section 50. Further, the lower-side horizontal conveying path 52 and the connection conveying path 54 are horizontally drawn out from the side of the connection conveying path 54 along the third direction Z. Incidentally, the third direction Z is coincident with the direction in which the sheet is sent from the connection conveying path 54 to the upper-side horizontal conveying path 53, and coincident with the direction in which the sheet is sent from the lower-side horizontal conveying path 52 to the connection conveying path 54. Thus, even in the case where there is a jammed sheet over the course between the upper-side horizontal conveying path 53 and the connection conveying path 54, when separating the connection conveying path 54 from the upper-side horizontal conveying path 53, the lower-side horizontal conveying path 52 and the connection conveying path 54 can be smoothly drawn out from the apparatus main body 2 without breaking the sheet.

Thereafter, as shown in FIG. 7, the guide plate 52*b* of the lower-side horizontal conveying path 52 is opened to perform jam handling operation on the lower-side horizontal conveying path 52.

Next, the third locking mechanism 58 is released to release the coupling between the upper-side horizontal conveying path 53 and the apparatus main body 2. Further, as shown in FIG. 4, the upper-side horizontal conveying path 53 is drawn out from the apparatus main body 2. Next, as shown in FIG. 5, the guide plate 53*b* of the upper-side horizontal conveying path 53 is opened to perform jam handling operation on the upper-side horizontal conveying path 53.

Incidentally, it is also possible to integrally draw out the lower-side horizontal conveying path 52, the upper-side horizontal conveying path 53 and the connection conveying path 54 to perform jam handling operation on the upper-side horizontal conveying path 53, and then only house the upper-side horizontal conveying path 53 into the apparatus main body 2, and perform jam handling operation on the lower-side horizontal conveying path 52.

In such a manner, with the image forming apparatus 1 of the present embodiment, jam handling operation can be performed from above in the second direction Y on both the lower-side horizontal conveying path 52 and the upper-side horizontal conveying path 53. As a result, since the operator does not have to perform operation from the lower side of the lower-side horizontal conveying path 52, jam handling operation can be facilitated.

Further, in the case where sheet jam occurs only in the connection conveying path 54, the reversing roller 54*c* is rotated to send the sheet to the lower-side horizontal conveying path 52 or the upper-side horizontal conveying path 53, and then the aforesaid jam handling operation is performed. Incidentally, in the case where the connection conveying path 54 is provided with a hinge, the guide plate 54*a* located on the outer side in the curvature radius direction may be opened to perform jam handling operation.

Incidentally, when performing maintenance of the reversing section 50, first, as shown in FIG. 4, the lower-side horizontal conveying path 52, the upper-side horizontal conveying path 53 and the connection conveying path 54 are integrally drawn out. Then, maintenance of the upper-side horizontal conveying path 53 arranged on the upper side in the second direction Y is performed.

After maintenance of the upper-side horizontal conveying path 53 has been completed, the second locking mechanism 57 is released to separate the upper-side horizontal conveying path 53 and the connection conveying path 54 from each other. Next, as shown in FIG. 6, only the upper-side horizontal conveying path 53 is housed into the apparatus main body 2, and then maintenance of the lower-side horizontal conveying path 52 is performed.

The present embodiment is described based on an example in which the lower-side horizontal conveying path 52 is connected to the second sheet-ejecting conveying path 72, which is continuous from the switching gate 48, and the upper-side horizontal conveying path 53 is connected to the sheet re-feeding path 74; however, the present invention is not limited to such example. For example, the present invention also includes a configuration in which the lower-side horizontal conveying path 52 is connected to the sheet re-feeding path 74, and the upper-side horizontal conveying path 53 is connected to the second sheet-ejecting conveying path 72. Further, the present invention also includes a configuration in which the sheet is conveyed from the upper-side horizontal conveying path 53 to the lower-side horizontal conveying path 52 through the connection conveying path 54.

The aforesaid embodiment of the image forming apparatus, including the advantages thereof, has been described above; however, it is to be understood that the image forming apparatus of the present invention is not limited to the embodiment described above, and various modifications can be made without departing from the spirit and scope of the present invention.

The aforesaid embodiment is described based on an example in which locking or releasing of the three locking mechanisms 56, 57, 58 is automatically performed based on the command from the controller 90; however, the present invention is not limited to such example. For example, locking or releasing of the three locking mechanisms may also be performed by the hand of the operator.

Further, although the aforesaid embodiment is described based on an example in which a monochromatic image is formed, the present invention may also be applied to an image forming apparatus in which a plurality of image forming sections are provided to form a color image.

What is claimed is:

1. An image forming apparatus comprising:

an image forming section adapted to form an image on a sheet;

a reversing section adapted to reverse the sheet between the front surface and the rear surface; and an apparatus main body that houses the image forming section and the reversing section, wherein the reversing section comprises:

a lower-side horizontal conveying path arranged horizontally and adapted to convey the sheet;

an upper-side horizontal conveying path arranged vertically above the lower-side horizontal conveying path and extending in parallel with the lower-side horizontal conveying path; and a connection conveying path which connects the lower-side horizontal conveying path and the upper-side horizontal conveying path to each other, and which is detachably coupled to the upper-side horizontal conveying path, and wherein the reversing section is horizontally supported by the apparatus main body so as to be horizontally movable along a direction in which the sheet is sent from the lower-side horizontal conveying path or the upper-side horizontal conveying path to the connection conveying path.

2. The image forming apparatus according to claim 1, further comprising a locking mechanism adapted to detachably couple the upper-side horizontal conveying path and the connection conveying path to each other.

3. The image forming apparatus according to claim 2, wherein the lower-side horizontal conveying path and the upper-side horizontal conveying path are each provided with a sensor adapted to detect the presence or absence of the sheet.

4. The image forming apparatus according to claim 3, further comprising a controller adapted to control locking and releasing of the locking mechanism based on the information detected by the sensor.

5. The image forming apparatus according to claim 4, wherein, when the sensor detects the sheet in the lower-side horizontal conveying path, the controller releases the locking mechanism, so that the lower-side horizontal conveying path and the connection conveying path can be integrally drawn out.

6. The image forming apparatus according to claim 4, wherein, when the sensor only detects the sheet in the upper-side horizontal conveying path, the controller causes the locking mechanism in lock state, so that the lower-side horizontal conveying path, the upper-side horizontal conveying path and the connection conveying path can be integrally drawn out.

7. The image forming apparatus according to claim 1, wherein the lower-side horizontal conveying path and the upper-side horizontal conveying path each have a pair of guide plates that face each other in the vertical direction, wherein, in each pair of guide plates, the guide plate arranged on the upper side in the vertical direction is supported by a hinge so as to be able to be opened and closed.

8. The image forming apparatus according to claim 1, further comprising:

a sheet-ejecting conveying path adapted to convey the sheet having an image formed thereon by the image forming section to the reversing section, wherein one of the lower-side horizontal conveying path and the upper-side horizontal conveying path is connected to the sheet-ejecting conveying path, and is adapted to change the conveyance direction of the sheet conveyed from the sheet-ejecting conveying path by approximately 90 degrees substantially horizontally, and wherein the other of the lower-side horizontal conveying path and the upper-side horizontal conveying path is adapted to change the conveyance direction of the sheet conveyed from the connection conveying path by approximately 90 degrees substantially horizontally.

* * * * *